US005685014A

United States Patent [19]

Dapsalmon

[11] Patent Number: 5,685,014

[45] Date of Patent: Nov. 11, 1997

[54] INDIVIDUAL PROTECTIVE GEAR TO GUARD AN UPPER LIMB AGAINST MECHANICAL RISKS

[75] Inventor: Christian Dapsalmon, Abondan, France

[73] Assignee: Comasec, Saint-Denis, France

[21] Appl. No.: 662,512

[22] Filed: Jun. 13, 1996

[30] Foreign Application Priority Data

Jun. 13, 1995 [FR] France ..... 95 07009

[51] Int. Cl.[6] ..... A41D 31/10; A41D 19/00

[52] U.S. Cl. ..... 2/16; 2/159; 2/161.6; 2/167

[58] Field of Search ..... 2/16, 20, 21, 158, 2/159, 161.6, 161.7, 163, 167, 168; 428/357, 364, 375, 392, 395; 57/210, 212, 223, 229, 230, 231, 238, 240, 241

[56] References Cited

U.S. PATENT DOCUMENTS

| | | | |
|---|---|---|---|
| 4,470,251 | 9/1984 | Bettcher | 2/167 |
| 4,825,470 | 5/1989 | Horio | 2/167 |
| 4,912,781 | 4/1990 | Robins et al. . | |
| 5,133,087 | 7/1992 | Machida et al. | 2/167 |
| 5,287,690 | 2/1994 | Toon . | |

FOREIGN PATENT DOCUMENTS

| | | |
|---|---|---|
| 0 118 898 | 9/1984 | European Pat. Off. . |
| 1.370.184 | 7/1964 | France . |
| 234716 | 11/1924 | United Kingdom . |

*Primary Examiner*—C. D. Crowder
*Assistant Examiner*—Larry D. Worrell, Jr.
*Attorney, Agent, or Firm*—Young & Thompson

[57] ABSTRACT

A knitted individual protective gear such as, a glove, muff or mitt for example, to guard an upper limb against mechanical risks, particularly cutting and/or abrasion, is characterized in that, the yarn (2) of high physical resistance with which the individual protective gear is knitted is a fiber core (3) surrounded by an outer fiber covering (4);

fibers of the core (3) have a selected color;

fibers of the covering (4) have a color chosen to be distinct from that of the core (3);

cuts and/or abrasion alter the covering (4) on a permanent basis, allowing the core (3) to be seen, so that the larger the alteration, the closer the shade of the altered parts will be to the color of the core (3), in order for the gear to have an indicator of the protection performance in the gear's current state.

13 Claims, 1 Drawing Sheet

INDIVIDUAL PROTECTIVE GEAR TO GUARD AN UPPER LIMB AGAINST MECHANICAL RISKS

FIELD OF THE INVENTION

The invention concerns an individual protective gear such as a glove, mitten, mitt or muff, to guard an upper limb against mechanical risks, particularly cutting and abrasion; a device as well as a method for determining the protection performance ensured by this gear.

BACKGROUND OF THE INVENTION

Individual protective gear used for safety-related purposes are classified according to the protection which they provide for the limbs (arms, legs, head) or body of their user, and based upon their intended use.

The technical field of the invention is that of protective gear to guard an upper limb against mechanical risks. In particular, gloves, mittens, mitts or muffs intended for operations involving risks of cutting and/or abrasion.

These gear are particularly intended for the use or handling of sharp-edged objects (machined parts, plate, glass, cutting tools, etc.).

Individual protective gear intended for such tasks are typically obtained by knitting a yarn with a high physical resistance.

Yarns comprising a fiber core surrounded by an outer fiber covering are widely used for these gear.

U.S. Pat. No. 3,883,898 can be referred to.

The protection, softness and comfort qualities of knitted safety gear account for their success during the last decades.

One disadvantage of these gear is that it is currently not possible to easily and instantly determine whether the gear has undergone alterations during prior uses, particularly due to cutting or abrasion.

Indeed, the protection performance of these knitted safety gear is only efficient if the alterations undergone during prior uses have not affected their integrity.

The problem is therefore to be able to easily and instantly determine if such a safety gear still has an adequate protection performance, or if it no longer meets this performance due its alteration.

Patent FR-1 370 184 describes an improved electrician's glove comprising a fiber core on which is applied a layer of insulating material, the latter being provided with an outer protective covering, and this covering having significantly different colors so as to make the wear of the glove visible by contrast.

But, contrarily to gloves knitted with high-resistance yarns, such a glove does not make it possible, on the one hand, to guarantee a sufficiently high mechanical protection performance for a large number of tasks when it is in good condition.

And, on the other hand, it does not allow for the determination of this mechanical protection performance at each desired instant.

Yet it is essential for not only the user, but also for another person, particularly a representative of the employer who is liable in case of non-conformity with legal safety requirements, to be able to make this determination.

SUMMARY OF THE INVENTION

One of the aims of the invention is to solve the problems mentioned above, while maintaining the advantages of high mechanical protection knitted gear.

For this purpose, a first object of the invention concerns a knitted individual protective gear, a glove, mitten, mitt or muff for example, to guard an upper limb against mechanical risks, particularly cutting and/or abrasion; characterized in that, on a combined basis:

- the yarn with which the individual protective gear is at least partially knitted comprises a fiber core surrounded by an outer fiber covering;
- fibers of the core and covering have a high resistance to cutting and/or abrasion;
- fibers of the core have a color chosen so that the core will have substantially the same color;
- fibers of the covering have a color chosen to be distinct from that of the core and cover the latter, so that the yarn and, in general, the individual protective gear as knitted will have substantially the same color as the fibers of the covering;
- the individual protective gear is conformed so that cuts and/or abrasion will alter the fiber covering on a permanent basis, allowing the core to be seen;
- the altered parts of the protective gear have a color distinct from that of the protective gear as knitted, the lesser the alteration, the closer the shade of these parts will be to the color of the covering, and the larger the alteration, the closer it will be to the color of the core; and
- since the alteration is inversely proportional to the mechanical protection performance of the gear, the shade makes up an indicator of this performance in the gear's current state.

In this gear, the core and the covering both contribute to the protection against mechanical risks, and simultaneously serve as an indicator of the performance of this protection.

According to one characteristic, the high-resistance fibers are chosen from amongst aramids, polyethylenes, carbons, glasses, metal fibers and/or technical fibers with a high resistance to cutting, or similar.

In one example, the yarn is of the type whose core and/or covering fibers have been subjected to twisting, obtained by spinning the fibers on a ring spinning frame for example.

According to one characteristic, the gear comprises, at least in certain parts such as the cuff, a weft insertion of elastic yarns, made of latex or synthetic for example, so as to make this part stretchable.

According to one characteristic, fibers of the core and/or covering of the yarn are dyed with the color chosen, by full bath dyeing for example.

According to another characteristic, the color of the core and/or covering fibers resists without substantial alteration in case the gear is washed.

The gear is knitted without seams.

But, alternatively, it comprises several pieces, possibly knitted or woven and cut, assembled by seaming for example.

According to one embodiment, the gear is ambidextrous.

In the case where the gear is a glove, a mitten or a mitt, according to one characteristic it comprises, on the palm and/or the fingers for example, at least one added-on outer material with a high coefficient of friction, particularly synthetic such as PVC, rubber or similar, so as to improve grasping when using this gear.

According to one embodiment, the gear comprises at least one outer reinforcement such as a piece of leather, a hardened coating area or similar, contributing to the protection of the gear against chemical and/or mechanical risks such as pinholes.

According to one characteristic, the gear comprises at least one partial or total added-on inner thickness, such as an underglove, inferlining, to provide thermal insulation and/or to increase comfort for example.

In one example, the gear comprises, near the cuff or on the latter for example, information such as instructions for use and/or a device for determining its mechanical protection performance.

A second object of the invention is a device for determining the mechanical protection performance of a gear according to the above-mentioned first object in its current state, this device comprising at least one colored area whose color corresponds to a predefined gear alteration shade indicating that the gear no longer ensures the mechanical protection performance initially required for its intended use, this device comprising at least two areas of different colours for example.

A third object of the invention concerns a method for determining the mechanical protection performance of a gear according to the above-mentioned first object in its current state, this method consisting of comparing the colour of at least one part of the protective gear with a reference color, on a slightly altered or unaltered part of the gear such as its back for example, or on a device comprising a colored reference area.

BRIEF DESCRIPTION OF THE DRAWINGS

The invention is described in detail with reference to the attached drawings, provided only as an example.

DETAILED DESCRIPTION OF THE INVENTION

In the description, the term "individual protective gear" designates a portable safety accessory intended to protect an upper limb of its user.

Figure 1:
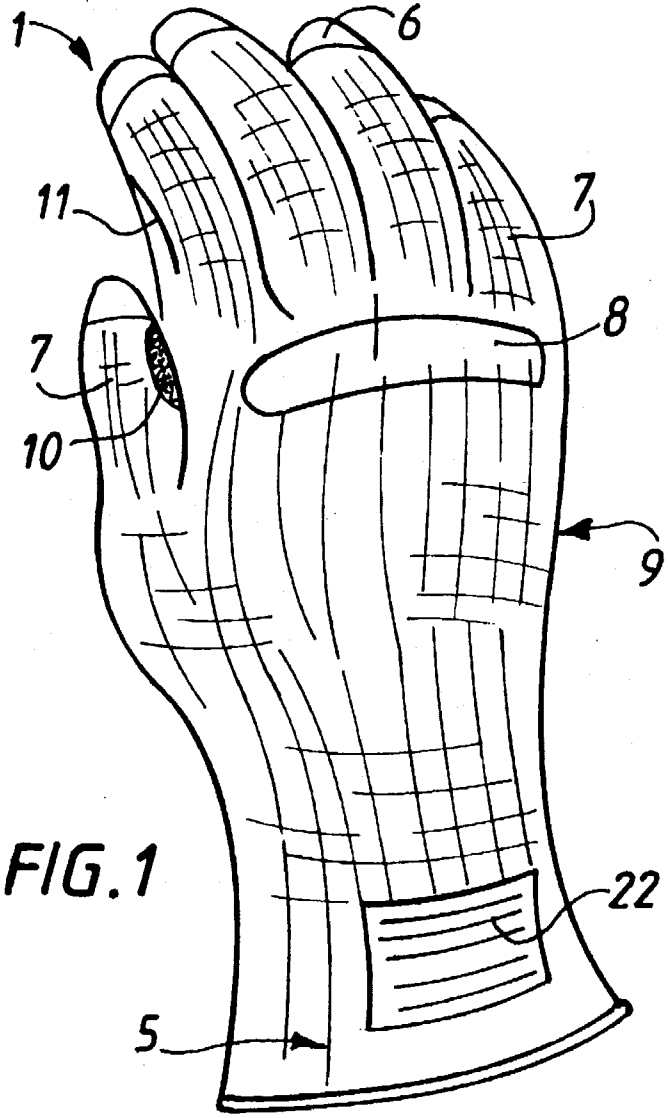
FIG. 1 is a perspective view of an individual protective gear in the form of a glove, according to the invention.

It can consist of a glove such as that indicated by reference numeral 1 in FIG. 1, or a mitten, mitt, muff, etc.

The main purpose of gear such as the glove 1 is to provide protection against mechanical risks, particularly risks of cutting and/or abrasion.

The protective gear concerned are of "knitted" type.

This means that the gear 1 is at least partially obtained by knitting a yarn with a high physical resistance.

Figure 2:
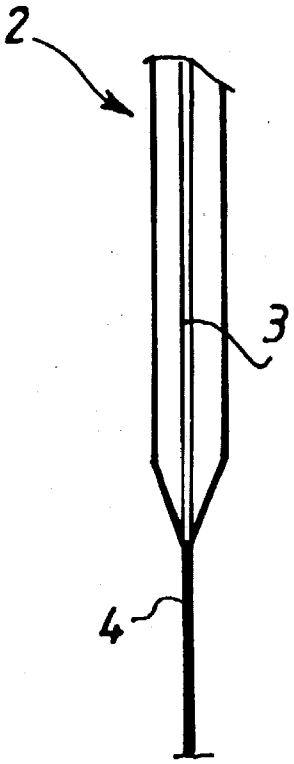
FIG. 2 is a partial schematic view of a yarn with which an individual protective gear according to the invention can be knitted, with the core and covering fibers partially dissociated.

An example of a yarn 2 used to knit the glove 1 is shown in FIG. 2.

Such a yarn comprises a fiber core 3, surrounded by an outer fiber covering 4.

Here the term "fiber" applies to any yarn 2 comprising short, long or continuous fibers or a mixture of these fibers.

To obtain the desired, mechanical protection performance the core 3 of the yarn 2, as well as its outer covering 4, comprise fibers with a high resistance to cutting and/or abrasion.

The composition of the high-resistance fibers of the yarn 2 is chosen from amongst aramids, polyethylenes, carbons, glass and/or metal fibers such as stainless steel fibers.

In the glove of FIG. 1, fibers of the core 3 and outer covering 4 of the knitted yarn 2 are high-tenacity technical fibers, respectively subject to prior twisting. Such a yarn 2 is said to be "core-spun".

Once the mechanical protection performance has been achieved, the yarn 2 may comprise, if this is desirable, fibers making it possible to achieve other specific requirements, such as natural fibers (cotton, etc.) to improve the ease of use of the gear.

The glove 1 illustrated comprises, near the part indicated by reference numeral 5 which makes up its cuff, a weft of elastic yarns so as to make this part stretchable. Here the elastic yarns of the weft are yarns made of latex or covered with a synthetic elastic material.

Such a weft of elastic yarns makes it possible to maintain the glove 1 on the hand of its user in a firm but removable manner.

Other parts of the glove 1 can be provided with such a weft if necessary.

The glove 1 illustrated is a glove knitted with a single piece without seams, and ambidextrous.

Alternatively, it is possible to obtain a protective gear according to the invention which comprises several additional pieces, at least one of which is knitted using a yarn 2 with a high physical resistance.

One or several of the additional pieces can be woven or cut pieces; for example, a stretchable muff can be obtained by seaming when assembling the various pieces of such a gear.

In the yarn 2 with which the individual protective gear is at least partially knitted, with fibers of the core 3 having a color chosen so that this core will have substantially the same color. For example, the fibers of the core 3 give the latter a dark color, such as black.

Whereas fibers of the covering 4 have a color chosen to be distinct from that of the core 3. These fibers of the covering 4 mask the core 3 so that the yarn 2, and the protective gear in general, as knitted, will have substantially the same color as the fibers of the covering 4.

To contrast with dark colored fibers of the core 3, the fibers of the covering 4 are, for example, light colored, particularly yellow.

Here the term "as knitted" refers to a state of the safety gear in which it ensures a required performance in terms of protection against mechanical risks.

This is the new state of the gear, or a state in which its structure has not been subject to an alteration such that the gear no longer ensures the performance required for its intended use.

By providing a yarn 2 in which the fibers of the core 3 and of the covering 4 have distinct colors, and by arranging the fibers of the covering 4 such that they substantially cover the core 3, a yarn is obtained whose color is substantially the same as that of the fibers of the covering 4. The same applies to the gear knitted using this yarn 2.

Furthermore, the protective gear is conformed so that the cuts and/or abrasion will alter the fiber covering 4 on a permanent basis, allowing the core 3 to be seen.

As a result, when the glove 1 is used, the lesser the alteration, the closer the shade of its altered parts will be to the color of the covering 4, and the larger the alteration, the closer it will be to the color of the core 3. Thus, the shade of the altered parts of the glove 1 changes according to its degree of alteration.

And since the alteration of the glove 1 is inversely proportional to the mechanical protection performance which it ensures, this shade is an indicator of the mechanical protection performance of the glove 1, in its current state.

This measurement is highly reliable, as it depends directly on the integrity of the structure of the yarn 2 and, subsequently, of the parts of a gear such as the glove 1 knitted using this yarn.

With such a gear, the mechanical protection performance of the gear in its current state is determined by comparing the color of at least one part of the latter with a reference color.

A reference color is visible on the parts of the glove 1 displaying little or no wear, which must be compared with the worn parts for this determination.

Referring to the examples illustrated, it can be seen that the glove 1 has, on the inner face of a finger 7, in this case the thumb, a worn part 10.

Since, as knitted, the yarn 2 has a generally light appearance, whereas the core 3, initially masked, has a dark colour, the worn part 10 stands out in contrast on the glove 1, in the form of a perfectly visible dark part.

Similarly, if a sharp-edged object affects the integrity of the yarn 2, as indicated by reference numeral 11 on the index finger of the glove, the altered part 11 is clearly visible, in the form of a "scar" in contrast with respect to the color of the neighbouring unaltered parts of the glove 1.

In this example, the altered part 10 stands out following an abrasion of the glove 1. Whereas the altered part 11 is due to a cut.

Although the glove of FIG. 1 provides for a gear, as knitted, with a light color, on which the alterations stand out with a dark color, other combinations of distinct colors can be provided.

Thus, when the protective gear is used in a soiling environment tending to darken its color, in the absence of an alteration, particularly due to its contact with dusty or greasy pieces, the fibers of the core 3 are light, whereas those of the covering 4 are dark, for example.

In this case, the altered parts will stand out distinctly in contrast to the protective gear even if it is dirty, in the form of light lines or areas consisting of fibers of the core 3 protruding from their initial covering 4.

In either case, various techniques can be used to obtain the distinction of color between the fibers of the core 3 and those of the covering 4.

For the glove of FIG. 1, the fibers of the core 3 are dyed with the color chosen, by dyeing in full bath. These fibers are aramid fibers.

In the case where the protective gear, here the glove 1, must be able to withstand washing, precautions are taken so that the color of the fibers of the core 3 and/or of the covering 4 will resist washing without substantial alterations.

This resistance of the colors keeps the colour of the core 3 and/or of the covering 4 of the yarn 2 from running on the covering 4 and/or the core 3, and vice versa. This could result in the colors no longer being distinct from one another.

After washing, the protective gear 1 on which altered parts of a color distinct from the general color of the gear as knitted stand out are discarded. Whereas the gear which are not marked by altered parts and therefore ensure the mechanical protection performance required are reused after washing.

With the example of the glove 1, good results have been obtained by giving the yarn 2 with which it is knitted a structure such that it comprises 70% covering fibers 4 of one color and 30% core fibers 3 of a colour distinct from the fibers of the covering 4.

Figure 3:
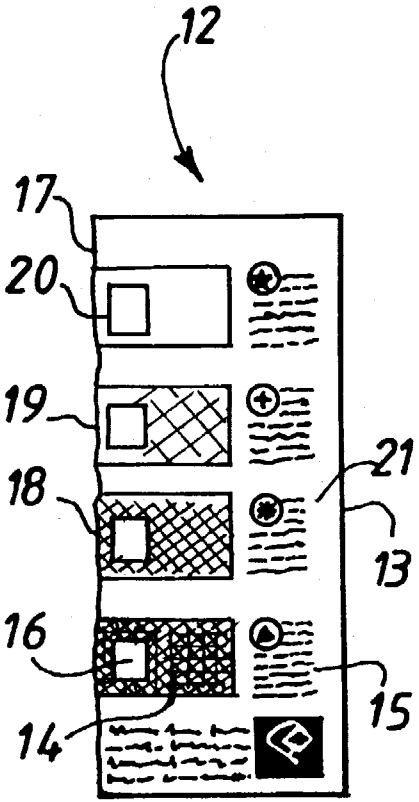
FIG. 3 is a plane view of a mechanical protection performance determining device, in accordance with the invention.

FIG. 3 shows an example of a device 12 for determining the protection performance, in its current state, of a safety gear such as the glove 1.

The determining device 12 comprises a base 13, here substantially rectangular, made of cardboard of plastic material.

The base 13 comprises an area 14 of a predefined color. This area 14 is obtained by printing, or by glueing a patch or a cut out knitted using the same yarn as the gear to be checked.

The color of the area 14 is determined, based upon laboratory tests of a predefined protective gear such as the glove 1 for example, so as to correspond to a shade of alteration of this gear such that it no longer ensures the protection performance required for its intended use.

Opposite to the area 14, the determining device 12 comprises indications 15. These indications mention that if at least part of this gear is of the same shade as the area 14, this gear must be discarded.

The comparison between a gear such as the glove 1 and the reference color area 14 can be made in two manners.

The first manner consists in positioning the determining device 12 so as to place an orifice 16 formed in the colored area 14 on top of an altered part.

The second manner consists in positioning a margin 17 of the device 12 consecutive to each colored area opposite to the glove 1 so as to compare the shades.

Needless to say, the check will be performed so as to account for the most altered—darkest—parts of the gear to be checked.

The device 12 of FIG. 3 comprises several coloured areas 18, 19 and 20. Each color area 18, 19 and 20 has a shade of color which corresponds to a predefined mechanical protection performance of the gear to be checked.

We have seen that the color of the area 14 corresponds to a performance such that the gear checked must be discarded.

Colored area 18 lies opposite to indications 21 which specify that if at least part of the gear checked has the same shade as this area 18, the mechanical protection performance of the gear in question limits its use to tasks for which this performance is sufficient.

The performance level is mentioned in the indications 21, in coded form for example.

Similarly, for colored area 19, the shade corresponds to a protection performance level superior to that which is indicated by areas 14 and 18.

And, in this case, colored area 20 has a shade corresponding to the as knitted state of the gear to be checked, which makes it possible to make sure that it is in good state, when it is new for example.

The glove 1 of FIG. 1 comprises added-on outer pieces 6 at the ends of its fingers 7.

Here, the added-on outer pieces 6 are made of synthetic PVC material. They make it possible to improve grasping when using this glove 1. These added-on pieces are obtained by coating in a place suited for solidification.

Other added-on outer pieces of materials with a high coefficient of friction, rubber or similar for example, can be provided on the glove 1, on the inside 9 of its palm for example. The same applies to any protective gear such as a mitten or mitt whose grasping performance needs to be improved.

Reference numeral 8 indicates an outer reinforcement. Here the outer reinforcement 8 is a piece of leather cut and stitched on the back 9 of the glove 1. The purpose of the outer reinforcement piece 9 is to increase the mechanical performance of the glove 1 against particular risks such as pin holes.

Other types of outer reinforcements can be provided on a protective gear.

In particular, hardened coating areas or the like can contribute to the protection of the gear against chemical and/or mechanical risks. Thus, the added-on outer pieces 6 can have more than just a grasp improving purpose; they can also contribute to the protection performance of the glove 1.

Although this is not illustrated, the glove 1 comprises an inserted inner thickness possibly but not necessarily made of woven fabric. Here, the inserted inner thickness is total and serves the purpose of an underglove or an interlining.

Such an inserted inner thickness is, depending on requirements, partial or total, and its purpose is to increase the thermal insulation and/or the comfort of the glove 1.

As mentioned earlier on, the glove 1 is conformed so that the cuts and/or the abrasion alter the fiber covering 4 on a permanent basis, allowing the core 3 to be seen.

This means that the added-on outer pieces 6 as well as the outer reinforcements 8 must not be arranged in such a way that they interfere with the display of the protection performance of the glove 1, by allowing the color of the core 3 to be seen.

This makes it necessary to choose the locations of such added-on outer pieces 6 or reinforcements 8, for example in the form of lines or pins glued on the glove 1 and arranged so as to not artificially interfere with the visibility of the core 3 when the protective gear has undergone an alteration.

Furthermore, it can be seen that the glove 1 comprises information 22. This information 22 is attached to the glove 1 on its cuff 5. It can be arranged in another location, possibly but not necessarily near the cuff 5.

Here the information 22 includes instructions for use of the glove 1. It indicates its size, its initial performance level, the various types of protection (mechanical, chemical, etc.) which it is capable of providing, but also its compliance with a safety rule or similar.

The information 22 is printed directly on the glove 1. Alternatively, it is provided on a fabric label, stitched or glued on the glove 1.

In an example not shown, the information 22 includes a device 12 for determining the mechanical protection performance of the glove 1, and for example a stamp provided with colored areas.

The performance of the glove in its current state can then be determined, for example by folding it and comparing the worn parts such as part 10 with the colored areas of the device included with the information 22.

The invention is not limited to the examples described.

I claim:

1. A knitted individual protective gear to guard an upper limb against mechanical risks, wherein:

the protective gear is at least partially knitted with yarn comprising a core of fibers surrounded by an outer fiber covering;

the fibers of the core and of the covering have a high resistance to at least one of cutting and abrasion;

the fibers of the core have substantially the same color;

the fibers of the covering have a color distinct from that of the core and cover the core such that the knitted protective gear will have substantially the same color as the fibers of the covering, and any cut or abrasion of the protective gear will produce an altered part on the fiber covering, allowing the core to be seen;

each altered part of the gear has a color distinct from the knitted protective gear, such that the lesser the extent of alteration, the closer the shade of the altered part will be to the color of the covering, and the greater the extent of alteration, the closer the shade of the altered part will be to the color of the core, whereby the shade acts as an indicator of the protection performance of the gear.

2. The gear according to claim 1, wherein the high resistance fibers are selected from the group consisting of aramid, polyethylene, carbon, glass, and metal fibers.

3. The gear according to claim 1, wherein the fibers of the yarn have been subjected to twisting, obtained by spinning the fibers on a ring spinning frame.

4. The gear according to claim 1, wherein the gear is a glove having a stretchable cuff which includes a weft insertion of elastic yarns, made of one of latex and synthetic material.

5. The gear according to claim 1, wherein the distinct respective colors of the fibers of the core and of the covering are obtained by dying the fibers in a respective bath.

6. The gear according to claim 1, wherein the distinct respective colors of the fibers of the core and of the covering are water resistant.

7. The gear according to claim 1, wherein the gear is knitted without seams.

8. The gear according to claim 1, wherein the gear comprises several pieces assembled with seams.

9. The gear according to claim 1, wherein the gear is ambidextrous.

10. The gear according to claim 1, wherein the gear is a glove having a palm and fingers, and including on at least one of the palm and the fingers one added-on outer material having a high coefficient of friction.

11. The gear according to claim 1, further comprising at least one outer reinforcement.

12. The gear according to claim 1, further comprising an inner lining.

13. The gear according to claim 4, further comprising, near the cuff, means for determining the mechanical protection performance of the protective gear.

* * * * *